US005120081A

United States Patent [19]

Longoria et al.

[11] Patent Number: 5,120,081

[45] Date of Patent: Jun. 9, 1992

[54] PARACHUTE AND SKATE APPARATUS

[76] Inventors: Lorenzo P. Longoria; Libertad V. Longoria, both of 6333 Vincent Dr., Corpus Christi, Tex. 78412

[21] Appl. No.: 701,744

[22] Filed: May 17, 1991

[51] Int. Cl.[5] ..... A63C 11/00

[52] U.S. Cl. ..... 280/810; 242/96; 242/100.1; 244/152; 244/155 A; 446/49

[58] Field of Search ..... 280/809, 810; 114/103, 114/39.2; 244/155 A, 152; 446/49; 242/96, 100.1

[56] References Cited

U.S. PATENT DOCUMENTS

| | | | |
|---|---|---|---|
| 2,018,062 | 10/1935 | Hardt | 280/810 |
| 2,067,571 | 1/1937 | Jamieson | 446/49 |
| 2,743,068 | 4/1956 | Walker | 242/100.1 |
| 2,807,426 | 9/1957 | Kelem et al. | 242/100.1 |
| 3,370,378 | 2/1968 | Simonini, Jr. | 446/49 |
| 3,871,605 | 3/1975 | Kupperman et al. | 446/49 |
| 4,722,497 | 2/1988 | Stanford et al. | 280/810 |

FOREIGN PATENT DOCUMENTS

| | | | |
|---|---|---|---|
| 2900681 | 7/1980 | Fed. Rep. of Germany | 280/810 |
| 1499954 | 11/1967 | France | 280/810 |
| 475770 | 9/1969 | Switzerland | 280/810 |

*Primary Examiner*—Eric D. Culbreth
*Attorney, Agent, or Firm*—Leon Gilden

[57] ABSTRACT

A parachute assembly is utilized in combination with a skate pair, wherein the skate pair is mounted by an individual and the individual supports the parachute assembly. The parachute assembly includes a flexible canopy, including a peripheral substantially annular edge, with a plurality of flexible cords mounted to the canopy. The cords are spaced from the canopy and terminate in a handle. A sleeve member is slidably mounted between the handle to encompass the cords, whereupon the sleeve member is slidably adjustable between the handle and the canopy to adjust effective length of the cords and thereby adjust effective opening available to the canopy.

1 Claim, 4 Drawing Sheets

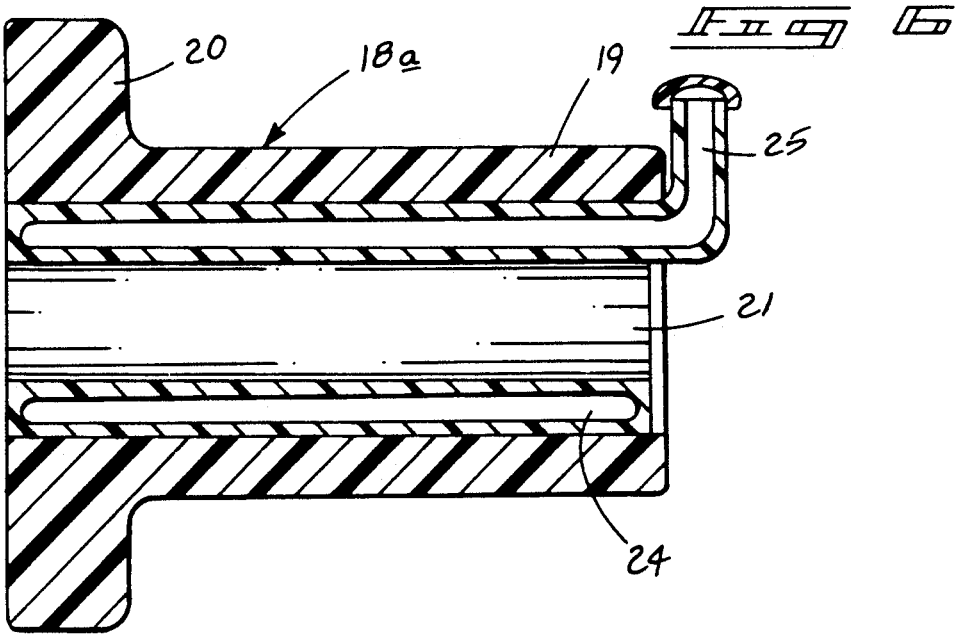
FIG 6
FIG 7
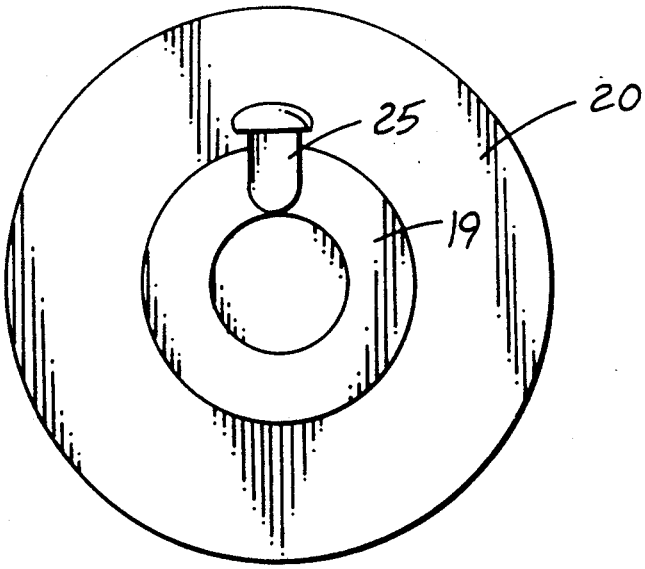

PARACHUTE AND SKATE APPARATUS

BACKGROUND OF THE INVENTION

1. Field of the Invention

The field of invention relates to toy and transport devices, and more particularly pertains to a new and improved parachute and skate apparatus wherein the same is arranged for harnessing wind currents to effect mobility to an individual mounting a pair of skates.

2. Description of the Prior Art

Parachute apparatus has been utilized in the prior art. Such apparatus is typically utilized to slow down a rate of descent of airborne individuals and objects. Contemporarily, parachutes are utilized in various sports such as para-sailing where an individual grasps a parachute and is towed by a vehicle such as a boat to effect airborne positioning and towing of the individual.

Prior art parachute apparatus is exemplified is U.S. Pat. No. 3,370,378 to Simonini wherein a parachute is mounted within a tubular structure and is released to effect a slowing or signaling of termination of a racing event.

U.S. Pat. No. 2,067,571 Jamieson sets forth a toy parachute wherein a sliding weight is mounted on the cords of the parachute for spacing of the weight relative to the parachute to control its opening.

U.S. Pat. No. 3,871,605 Kupperman sets forth a parachute member secured relative to shroud lines of a parachute to permit ascent of the parachute along the lines.

As such, it may be appreciated that there continues to be a need for a new and improved parachute and skate apparatus as set forth by the instant invention which addresses both the problems of ease of use as well as effectiveness in construction in permitting use of a parachute to transport an individual and in this respect, the present invention substantially fulfills this need.

SUMMARY OF THE INVENTION

In view of the foregoing disadvantages inherent in the known types of parachute apparatus now present in the prior art, the present inventio provides a parachute and skate apparatus wherein the same are utilized to effect transport and mobility of an induvidual about a surface. As such, the general purpose of the present invention, which will be described subsequently in greater detail, is to provide a new and improved parachute and skate apparatus which has all the advantages of the prior art parachute apparatus and none of the disadvantages.

To attain this, the present invention provides a parachute assembly utilized in combination with a skate pair, wherein the skate pair is mounted by an individual and the individual supports the parachute assembly. The parachute assembly includes a flexible canopy, including a peripheral substantially annular edge, with a plurality of flexible cords mounted to the canopy. The cords are spaced from the canopy and terminate in a handle. A sleeve member is slidably mounted between the handle to encompass the cords, whereupon the sleeve member is slidably adjustable between the handle and the canopy to adjust effective length of the cords and thereby adjust effective opening available to the canopy.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be descibed hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved parachute and skate apparatus which has all the advantages of the prior art parachute apparatus and none of the disadvantages.

It is another object of the present invention to provide a new and improved parachute and skate apparatus which may be easily and efficiently manufactured and marketed.

It is a further object of the present invention to provide a new and improved parachute and skate apparatus which is of a durable and reliable construction.

An even further object of the present invention is to provide a new and improved parachute and skate apparatus which is susceptible of a low cost of manufacture with regard to both materials and labor, and which accordingly is then susceptible of low prices of sale to the consuming public, thereby making such parachute and skate apparatus economically available to the buying public.

Still yet another object of the present invention is to provide a new and improved parachute and skate apparatus which provides in the apparatuses and methods of the prior art some of the advantages thereof, while simultaneously overcoming some of the disadvantages normally associated therewith.

Still another object of the present invention is to provide a new and improved parachute and skate apparatus wherein the same is arranged to adjustably transport an individual about a support surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is an orthographic cross-sectional illustration of a modified sleeve structure utilized by the instant invention.

FIG. 7 is an orthographic end view of the modified sleeve structure as set forth in FIG. 6.

DESCRIPTION OF THE PREFERRED EMBODIMENT

Figure 1:
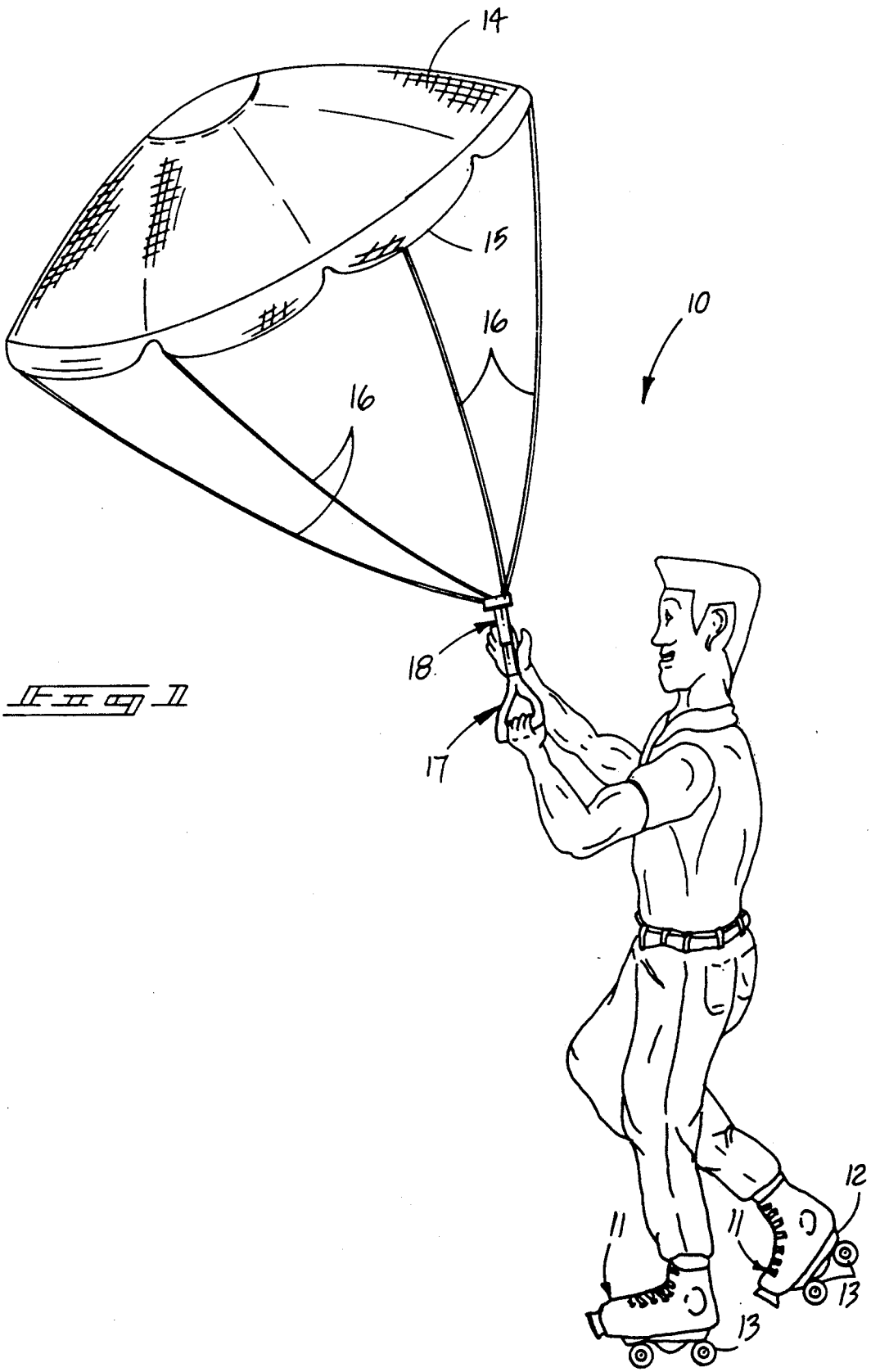
FIG. 1 is an orthographic side view of the instant invention in use.
Figure 2:
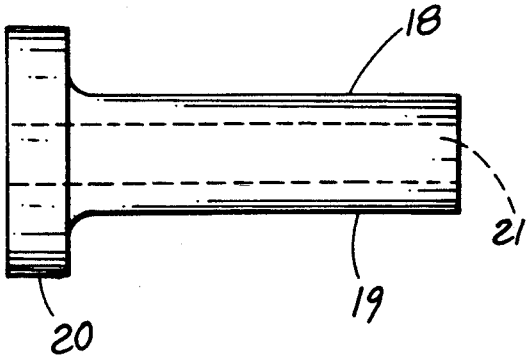
FIG. 2 is an orthographic side view of the adjustment sleeve utilized by the instant invention.
Figure 3:
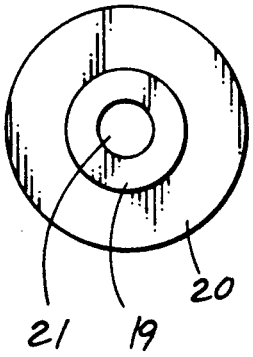
FIG. 3 is an orthographic end view of the adjustment sleeve.
Figure 4:
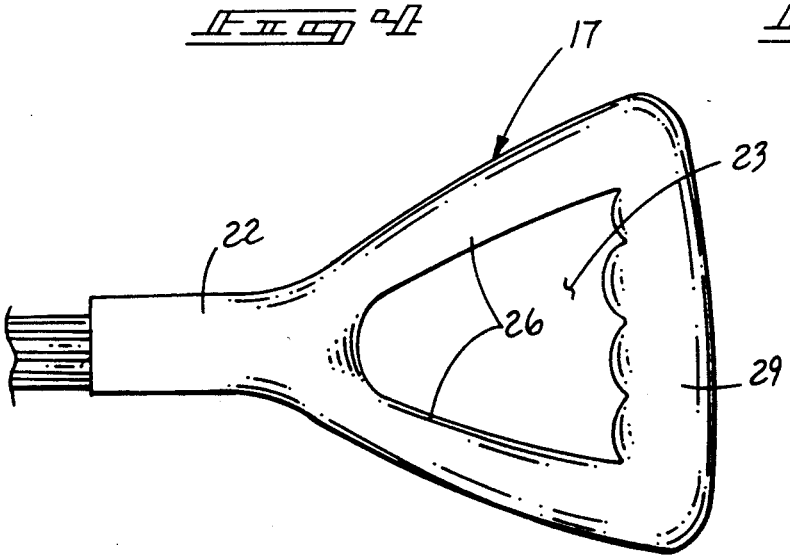
FIG. 4 is an orthographic side view of the handle utilized by the invention.
Figure 5:
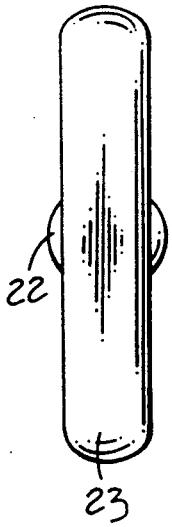
FIG. 5 is an orthographic end view of the handle utilized by the invention.

With reference now to the drawings, and in particular to FIGS. 1 to 10 thereof, a new and improved parachute and skate apparatus embodying the principles and concepts of the present invention and generally designated by the reference numeral 10 will be described.

More specifically, the parachute and skate apparatus 10 of the instant invention essentially comprises the inclusion of a plurality of roller skate members 11 for mounting to the feet of an individual, as illustrated, wherein the roller skate members 11 each include a support sole 12, and each support sole mounts a plurality of roller cylinders 13 thereon in a rotative relationship relative to the support sole 12.

A flexible parachute canopy 14 defining a dome-like configuration when expanded, includes a canopy periphery 15 mounting a plurality of flexible cord pairs 16. The cord pairs 16 are directed through an adjustment sleeve 18 and slidably receives the cords therethrough. The cords are received within a handle 17. The handle 17 includes a handle tubular body (see FIGS. 4 and 5) and an enclosed handle loop 23 defined by bifurcated handle legs 26, with a handle member 29 mounted to outer terminal ends of the handle legs 26 to define the handle loop 23 for grasping. The adjustment sleeve 18 includes a tubular body 19, with a cylindrical abutment flange 20 mounted at a forward end of the tubular body 19 in confrontation to the parachute canopy 14. A central through-extending bore 21 coaxially directed through the tubular body 19 receives the cord pairs 16 slidably therethrough.

In use, an individual accommodates wind currents to expand the canopy to tension the cord pairs 16 to thereby direct an individual across a support surface when the individual has the roller skate members 11 worn in a manner as illustrated in FIG. 1. By sliding adjustment of the sleeve 18 to adjust effective length of the cord pairs 16 between the abutment flange 20 and the canopy 14, effective expansion of the canopy is adjusted and its wind accommodating configuration accordingly.

FIG. 6 illustrates the use of a modified sleeve **18*a*, wherein the tubular body 19 includes an inflatable pneumatic liner 24 coextensively directed about an interior surface of the central bore 21. In this manner, the liner through inflation valve 25 may be expanded to a desired degree and thereby effect constriction between the cord pairs 16** directed therethrough and thereby braking action of the handle relative to the cord pairs in assisting in placement of the handle in a desired orientation along the cord pairs.

Figure 8:
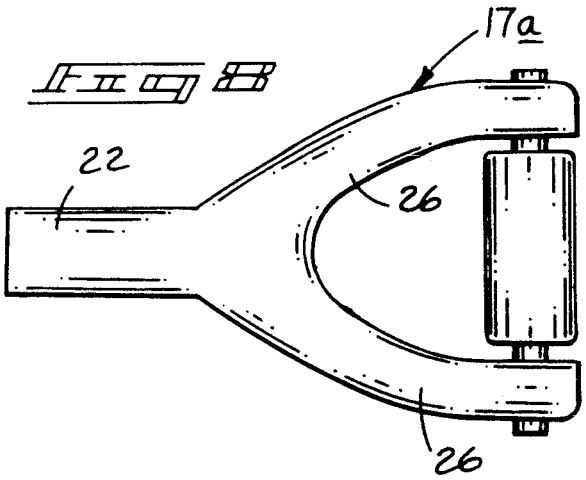
FIG. 8 is an orthographic top view of a modified handle utilized by the instant invention.
Figure 9:
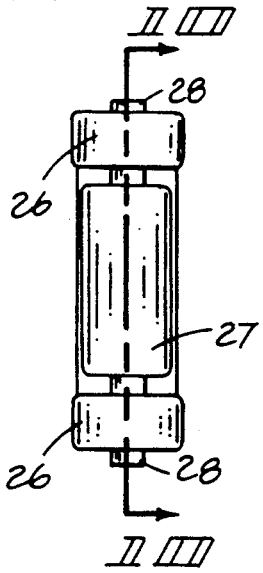
FIG. 9 is an orthographic end view of the modified handle as set forth in FIG. 8.
Figure 10:
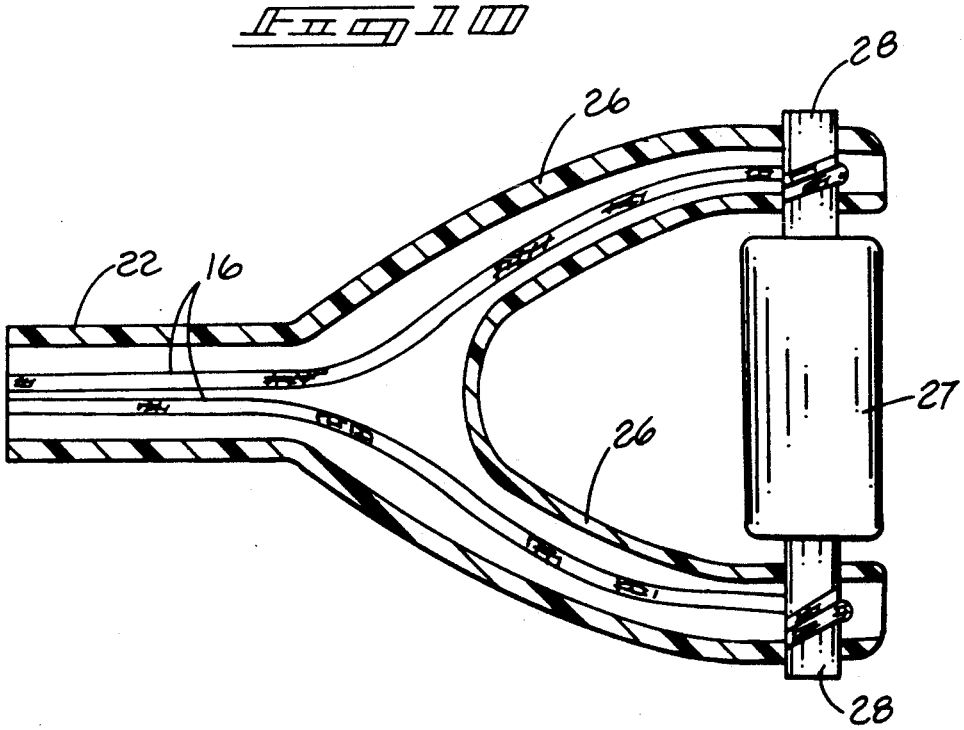
FIG. 10 is an orthographic view, taken along the lines 10—10 of FIG. 9 in the direction indicated by the arrows.

FIG. 8 illustrates the use of a modified handle **17*a*, wherein the handle tubular body 22 and the bifurcated legs 26 are of a hollow construction defining a "Y" shaped cavity to receive the cord pairs 16 therethrough. The cylindrical handle 27 is provided that is orthogonally directed through the free terminal ends of the bifurcated handle legs 26, with the cylindrical handle 27 including a handle axle 28 fixedly directed therethrough. The handle axle 28 is rotatably mounted at its opposed ends through the handle legs 26. The cords 16 are wound about the handle axle 28 contained within the handle legs 26 permitting a winding of the cord member 16 about the handle axles contained within the handle legs and thereby permit effective adjustment of effective length of the cord pairs 16 in use to permit adjustment of the cord pairs by the handle 17*a* or in combination with the sleeve structure 18 and 18*a*** as illustrated.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A parachute and skate apparatus, comprising in combination, a plurality of skate members, each skate member including a support sole, and each support sole rotatably mounting a plurality of roller cylinders relative to each support sole, and a flexible parachute canopy, the parachute canopy including a canopy periphery, and the canopy periphery including a plurality of flexible cord members extending from the canopy periphery and mounted within a handle spaced from the canopy periphery, and including an adjustment sleeve, the adjustment sleeve slidably mounted about the cord members, the adjustment sleeve including a coaxially aligned tubular body including a forward terminal end, and the tubular body including an abutment flange fixedly and orthogonally mounted to the tubular body forward terminal end, and the sleeve including a central bore extending through the tubular body and the abutment flange, with the central bore receiving the cord members therethrough, and the handle including a handle tubular body receiving the cord members therewithin, and the handle tubular body including an enclosed handle loop fixedly mounted to a rear terminal end of the handle tubular body, and the tubular body of the adjustment sleeve including an inflatable pneumatic liner, the inflatable pneumatic liner coextensively mounted within the central bore and includes an inflation valve in pneumatic communication with the pneumatic liner to effect adjustable resistance to the cord members directed through the central bore upon inflation of the pneumatic liner.

* * * * *